US012326303B2

(12) United States Patent
Song et al.

(10) Patent No.: US 12,326,303 B2
(45) Date of Patent: Jun. 10, 2025

(54) METHOD FOR MANUFACTURING COUNTER FLOW TOTAL HEAT EXCHANGER

(71) Applicants: Gil Sub Song, Incheon (KR); Eun Sook Hong, Incheon (KR); Eun Jung Hong, Incheon (KR)

(72) Inventors: Gil Sub Song, Incheon (KR); Eun Sook Hong, Incheon (KR); Eun Jung Hong, Incheon (KR)

(73) Assignee: GAONTECH CO., LTD. (KR)

( * ) Notice: Subject to any disclaimer, the term of this patent is extended or adjusted under 35 U.S.C. 154(b) by 168 days.

(21) Appl. No.: 18/001,594

(22) PCT Filed: Sep. 29, 2020

(86) PCT No.: PCT/KR2020/013346
§ 371 (c)(1),
(2) Date: Dec. 13, 2022

(87) PCT Pub. No.: WO2022/014779
PCT Pub. Date: Jan. 20, 2022

(65) Prior Publication Data

US 2023/0221076 A1 Jul. 13, 2023

(30) Foreign Application Priority Data

Jul. 13, 2020 (KR) ..... 10-2020-0086248

(51) Int. Cl.
*F28D 9/00* (2006.01)
*F28D 21/00* (2006.01)
(Continued)

(52) U.S. Cl.
CPC ..... *F28D 9/0037* (2013.01); *F28D 9/0025* (2013.01); *F28D 9/0081* (2013.01);
(Continued)

(58) Field of Classification Search
CPC .... F28D 9/0025; F28D 9/0037; F28D 9/0081; F28D 21/0015; F28D 21/066; F28F 3/025; F28F 3/14; F28F 21/065
See application file for complete search history.

(56) References Cited

U.S. PATENT DOCUMENTS

2003/0094269 A1* 5/2003 Arai ..... F28D 9/0062 165/905
2009/0126898 A1* 5/2009 Eplee ..... F28D 21/0015 165/10
(Continued)

FOREIGN PATENT DOCUMENTS

JP 11-230688 8/1999
JP 11230688 A * 8/1999
(Continued)

OTHER PUBLICATIONS

Machine translation of JP-11230688-A, retrieved Sep. 25, 2024 (Year: 2024).*

*Primary Examiner* — Eric S Ruppert
*Assistant Examiner* — Hans R Weiland

(57) ABSTRACT

A method for manufacturing a counter flow total heat exchanger is disclosed. The for comprises the steps of: inserting, between a pair of rollers (210, 210*a*) having protrusions formed on the surface thereof, a first paper having a first width, so as to form same into a single face corrugated cardboard sheet (T) having flow paths (111*c*, 121*c*); attaching the corrugated cardboard sheet (T) to a middle region of a second paper having a second width that is wider than the first width; cutting, into a length corresponding to guide corrugated cardboards (111,121), the second paper to which the corrugated cardboard sheet (T) is attached; and cutting the second paper to form a liner (130)
(Continued)

having triangular resin tube coupling surfaces (133) formed on both sides of the cut guide corrugated cardboards (111, 121).

3 Claims, 13 Drawing Sheets

(51) Int. Cl.
*F28F 3/02* (2006.01)
*F28F 3/14* (2006.01)
*F28F 21/06* (2006.01)

(52) U.S. Cl.
CPC ..... *F28D 21/0015* (2013.01); *F28F 3/025* (2013.01); *F28F 3/14* (2013.01); *F28F 21/066* (2013.01)

(56) References Cited

U.S. PATENT DOCUMENTS

2011/0146961 A1* 6/2011 Imai ..... D21H 17/64
165/170
2012/0168136 A1* 7/2012 Takada ..... F28D 9/0062
165/166

FOREIGN PATENT DOCUMENTS

KR 10-0911776 8/2009
WO WO2018/193849 10/2018
WO WO2019/054052 3/2019

* cited by examiner

METHOD FOR MANUFACTURING COUNTER FLOW TOTAL HEAT EXCHANGER

TECHNICAL FIELD

The present invention relates to a method for manufacturing a counter flow total heat exchanger, and more particularly, to a method of manufacturing a counter flow total heat exchanger, in which a flow path for supplying outdoor air and discharging indoor air is formed by using a hollow sheet to facilitate mass production.

Background Art

In general, ventilation is one of the most important parts in building structures, such as houses, buildings, department stores, theaters, stores, schools, hospitals, and the likes. However, when the ventilation is performed, since indoor air which has been warmed or cooled by using a heating device or an air conditioner is discarded to the outside, it makes the interior colder or hotter, thereby reducing indoor cooling or heating effects. To solve this problem, ventilators each having a total heat exchanger have been developed.

The conventional total heat exchangers are divided into a cross flow type, a propeller flow type, and a counter flow type, and the counter flow type heat exchange has been widely used since providing the highest heat exchanging efficiency.

FIG. 1 is a perspective view illustrating a configuration of a conventional counter flow total heat exchanger 30. As illustrated, the conventional counter flow total heat exchanger 30 includes an outdoor air supply unit 31 for supplying outdoor air A to the interior and an indoor air discharge unit 33 for discharging indoor air B to the outside. The outdoor air supply unit and the indoor air discharge unit are stacked on top of one another by turns, and a heat transfer film 35 is interposed between the outdoor air supply unit 31 and the indoor air discharge unit 33.

FIGS. 2A and 2B are perspective views respectively illustrating the outdoor air supply unit 31 and the indoor air discharge unit 33 of the counter flow total heat exchanger 30. As illustrated, the outdoor air supply unit 31 and the indoor air discharge unit 33 are provided in the form of a corrugated cardboard having a flow path through which air flows. In this instance, the outdoor air supply unit 31 includes an outdoor air inflow pipe 31*a*, an outdoor air guide pipe 31*b*, and an outdoor air outflow pipe 31*c* which are formed to communicate with each other. The indoor air discharge unit 33 includes an indoor air inflow pipe 33*a*, an indoor air guide pipe 33*b*, and an indoor air outflow pipe 33*c* which are formed to communicate with each other.

Here, the indoor air guide pipe 33*b* is formed in parallel with the outdoor air guide pipe 31*b*, and the indoor air inflow pipe 33*a* and the outdoor air discharge pipe 33*c* are respectively inclined to be opposed to the outdoor air inflow pipe 31*a* and the outdoor air discharge pipe 31*c*.

Accordingly, the air supply direction of the outdoor air A and the exhaust direction of the indoor air B are opposed to each other, and the total heat exchange is performed in this process.

However, in the conventional counter flow total heat exchanger 30, the outdoor air supply unit and the indoor air discharge unit are made of resin, and the heat transfer film is made of paper.

Since the outdoor air supply unit and the indoor air discharge unit, and the heat transfer film are made of different materials, there is a problem in that exchange of moisture is not properly performed.

In Korea, humidity load is high since there is a great difference between humidity in winter and humidity in summer. In such an environment, it is important to smoothly exchange moisture in the total heat exchanger. However, since the components of the counter flow total heat exchanger are made of different materials, the solid surface must absorb moisture in the flow path through which the indoor air and the outdoor air are moved, and then, the moisture must be transferred to the opposite side. In this instance, in a case in which the components are made of different materials, moisture may not be smoothly transferred.

In order to solve such a problem, Korean Patent No. 10-0911776 discloses a "total heat exchanger and a method for manufacturing a total heat exchanger". Korean Patent No. 10-0911776 proposed a manufacturing method for forming a heat transfer film, an outdoor air supply unit and an intake guide unit with paper in a roll-to-roll method.

However, in the conventional art, as illustrated in FIG. 3, a paper 50 is inserted between a pair of rollers 40 and 40*a* having concavo-convex portions formed in the opposite directions to form a flow path 51 in which peaks and valleys are repeated on the paper 50.

However, it is theoretically possible to form the flow path 51 in the paper 50, but in practice, since the paper has almost no deformation amount, it is difficult to maintain the shape of the flow path having the peaks and valleys, and thus it is impossible to perform actual processing.

That is, in order to form a desired flow path 51 using the paper 50, the paper 50 must be sufficiently thick, but if so, heat exchange performance is reduced. However, if the paper 50 is thin, the paper may be torn or it is difficult to maintain the processed shape.

DISCLOSURE

Technical Problem

Accordingly, the present invention has been made in view of the above-mentioned problems occurring in the related art, and it is an object of the present invention to provide a method for manufacturing a counter flow total heat exchanger capable of manufacturing a counter flow total heat exchanger using conventional roll-to-roll equipment as it is.

It is another object of the present invention to provide a method for manufacturing a counter flow total heat exchanger, in which an air flow path contacting a liner is made of the same paper as the liner, thereby increasing heat transfer efficiency and smoothly transferring moisture.

It is a further object of the present invention to provide a method for manufacturing a counter flow total heat exchanger, which can simply manufacture a counter flow total heat exchanger without complicated manufacturing equipment.

Technical Solution

To accomplish the above-mentioned objects, according to the present invention, there is provided a method for manufacturing a counter current total heat exchanger comprising the steps of: inserting a first paper having a first width between a pair of rollers (210, 210*a*) ha g protrusions formed on the surfaces thereof to form a corrugated cardboard sheet (T) having flow paths (111*c*, 121*c*) of a single facer; adhering the corrugated cardboard sheet (T) to a middle region of a second paper having a second width that is wider than the first width; cutting the second paper, to which the corrugated cardboard sheet (T) is adhered, into a length corresponding to guide corrugated cardboards (111, 121); and cutting the second paper by means of a liner (130) having triangular resin tube coupling surfaces (133) formed on both sides of the cut guide corrugated cardboards (111, 121).

In addition, preferably, the method for manufacturing a counter current total heat exchanger includes the steps of: cutting a hollow sheet (300) in which a plurality of air movement paths are formed side by side into resin pipes (115, 117, 125, 127) corresponding to the shape of the resin pipe coupling surfaces (133); adhering a pair of the cut resin pipes (115, 117, 125, 127) to the resin pipe coupling surfaces (133) of both sides of the liner (130) in such a way that the air movement paths (340) communicate with the flow paths (111*c*, 121*c* and adhering the guide corrugated cardboards (111, 121) and the plurality of liners (130) to which the resin pipes (115, 117, 125, 127) are coupled to the upper surface in a height direction.

Advantageous Effects

The method for manufacturing the counter flow heat exchanger according to the present invention can manufacture an outdoor air guide corrugated cardboard, an indoor air guide corrugated cardboard, and a liner with general paper by using conventional roll-to-roll equipment.

In addition, the method according to the present invention can simply manufacture the outdoor air supply unit and the indoor air discharge unit by cutting a hollow sheet sold in the market, processing a resin pipe, and adhering the resin pipe to a liner. Additionally, the outdoor air supply unit and the indoor air discharge unit are stacked on top of one another by turns.

Therefore, the method according to the present invention can reduce manufacturing costs since the counter flow heat exchanger is completely manufactured just by the existing roll-to-roll equipment, cutting device, and adhering device without any special equipment.

In addition, since the counter flow total heat exchanger manufactured as described above has the liner, the outdoor air guide corrugated cardboard, and the indoor air guide corrugated cardboard which are made of the same material, thereby enhancing heat transfer efficiency and moisture transfer efficiency.

EXPLANATION OF REFERENCE NUMERALS

Figure 1:
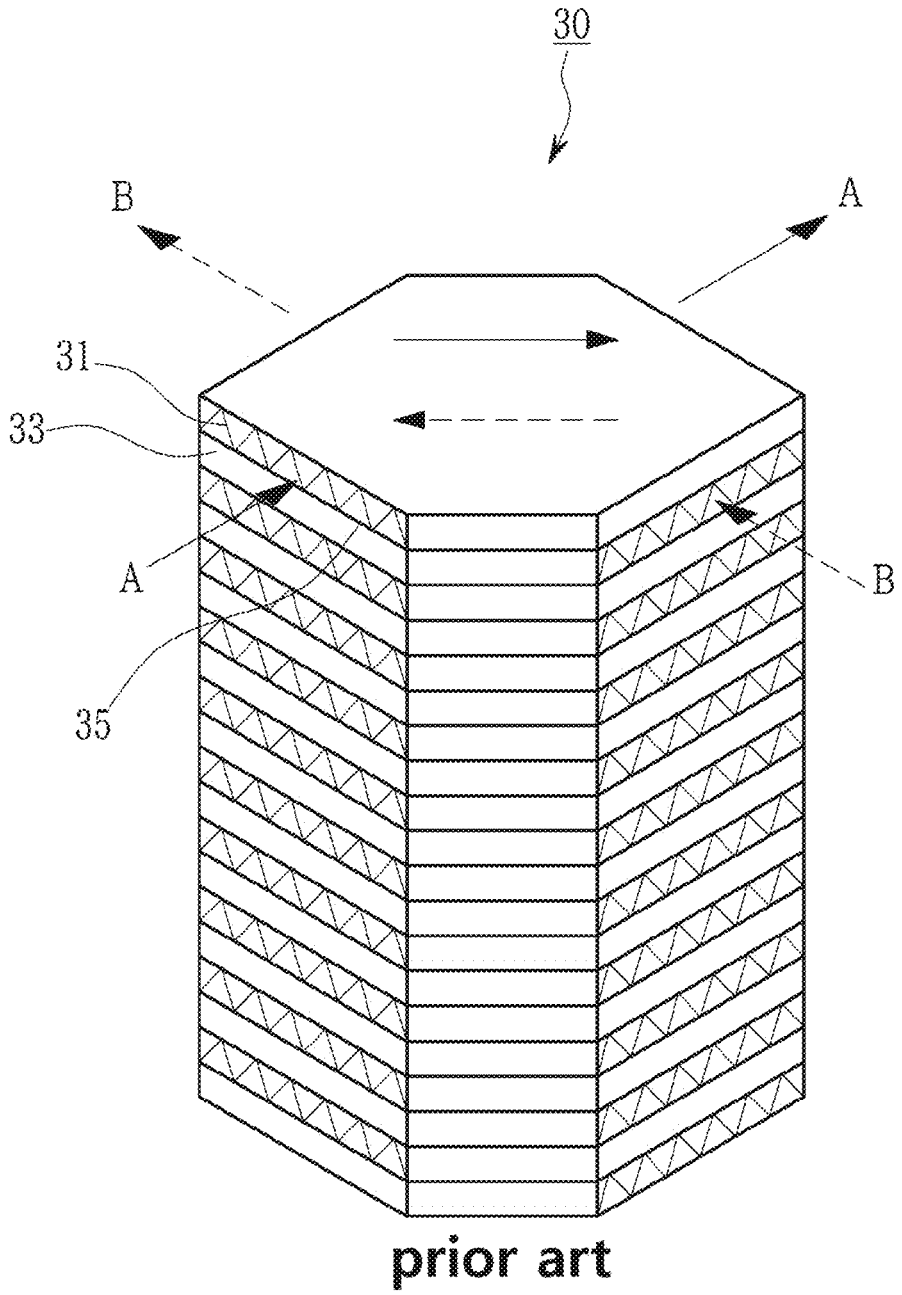
FIG. 1 is a perspective view illustrating a configuration of a conventional counter flow total heat exchanger.
Figure 2A:
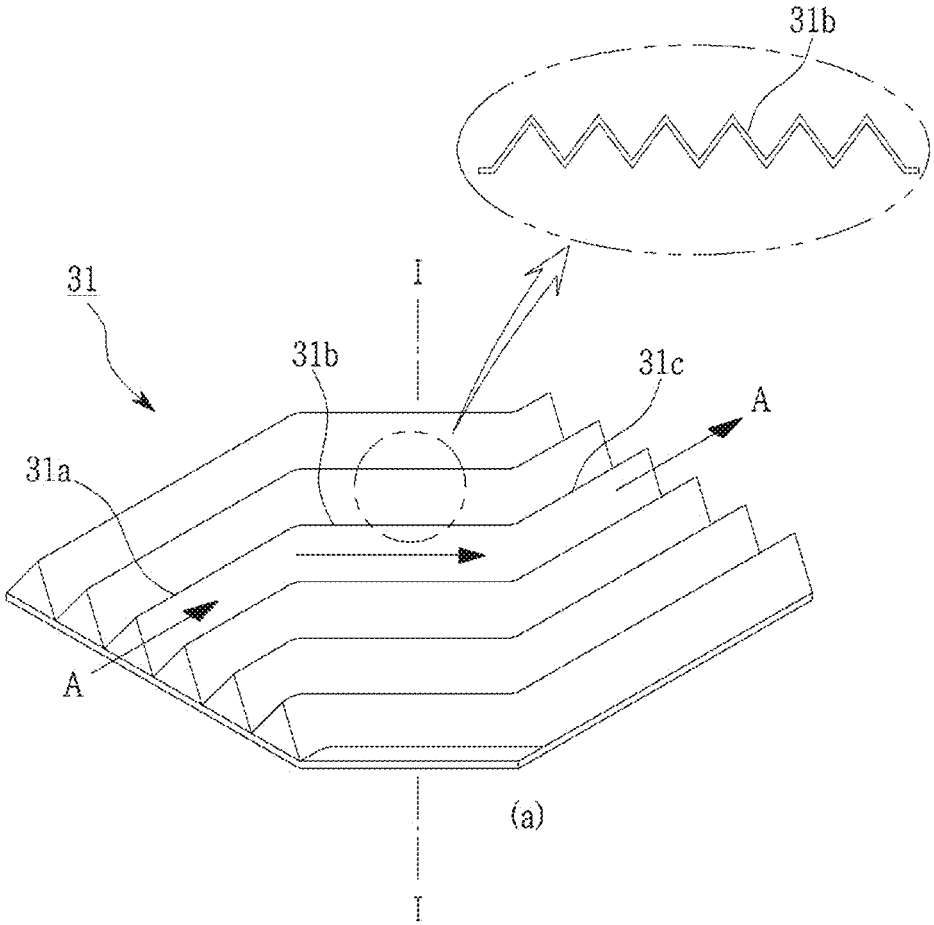
FIGS. 2A and 2B are views illustrating an outdoor air supply unit and an indoor air discharge unit of the conventional counter flow total heat exchanger.
Figure 2B:
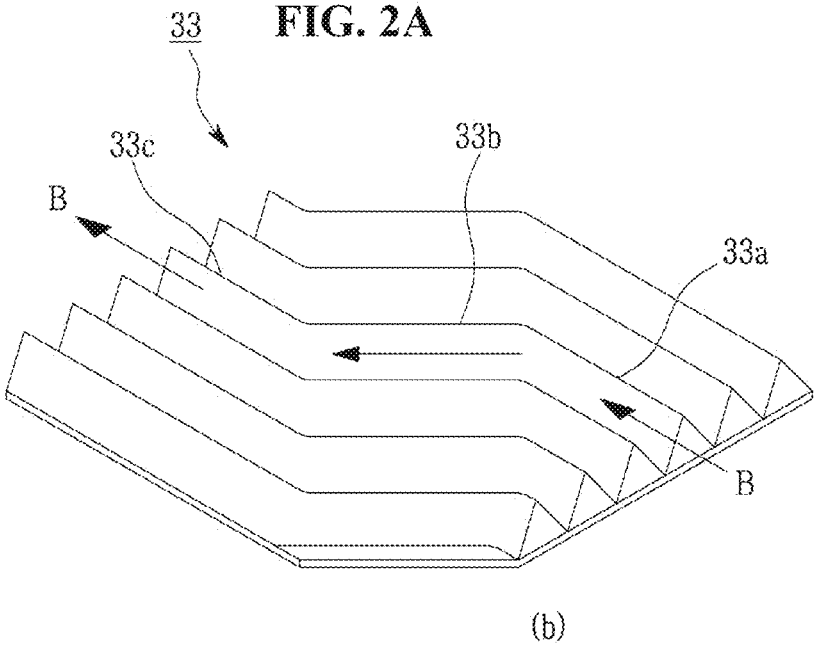
prior art FIG. 2B
Figure 3:
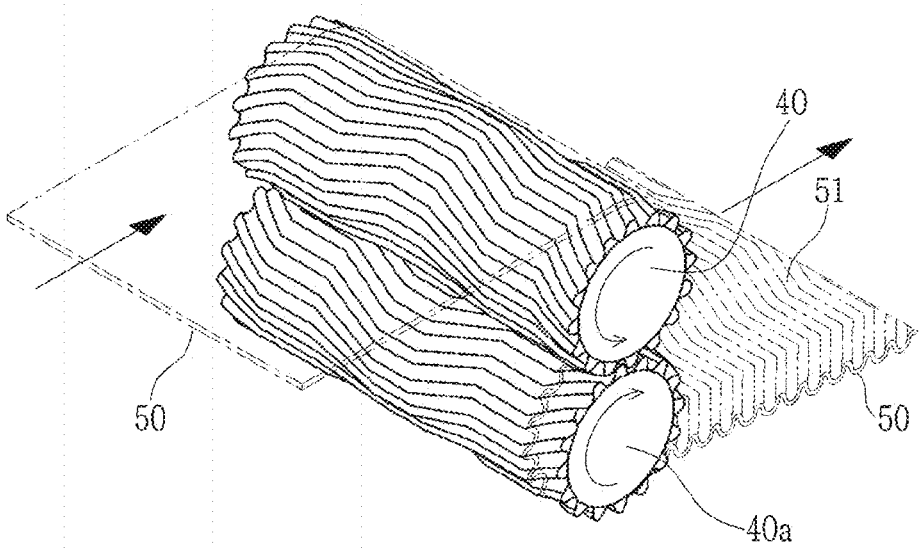
prior art FIG. 3
FIG. 3 is a view illustrating a manufacturing process of the conventional counter flow total heat exchanger.

100: Counter flow total heat exchanger 110: Outdoor air supply unit
111: Outdoor air guide corrugated cardboard 111*a*: Peak
111*b*: Valley 111*c*: Outdoor air guide path
113: Outdoor air side wall 115: Outdoor air inflow resin pipe
115*a*: Bottom plate 115*b*: upper plate
115*c*: partition wall 115*d*: outdoor air inflow path
115*e*: Outdoor air inlet 117: Outdoor air outflow resin pipe
120: Indoor air discharge part 121: Indoor air guide corrugated cardboard
123: Indoor air side wall 125: Indoor air inflow resin pipe
125*e*: Indoor air inlet 127: Indoor air outflow resin pipe
127*e*: Indoor air outlet 130: Liner
131: Corrugated coupling surface 133: Resin tube coupling surface
210: First roller 210*a*: Second roller
220: Second paper supply roller 300: hollow sheet
310: Upper surface 320: Lower surface
330: Vertical wall 340: Air movement path
A: outdoor air
B: indoor air
E: Adhesive
H: Heat
P1: First paper
P2: Second paper
T: Corrugated sheet

MODE FOR INVENTION

Hereinafter, preferred embodiments of the present invention will now be described in detail with reference to the attached drawings, in which like reference numbers denote corresponding parts throughout the drawings.

The terms "comprising" and "including" in the discussion directed to the present invention and the claims are used in an open-ended fashion and thus should be interrupted to mean "including", but not limited thereto.

Figure 4:
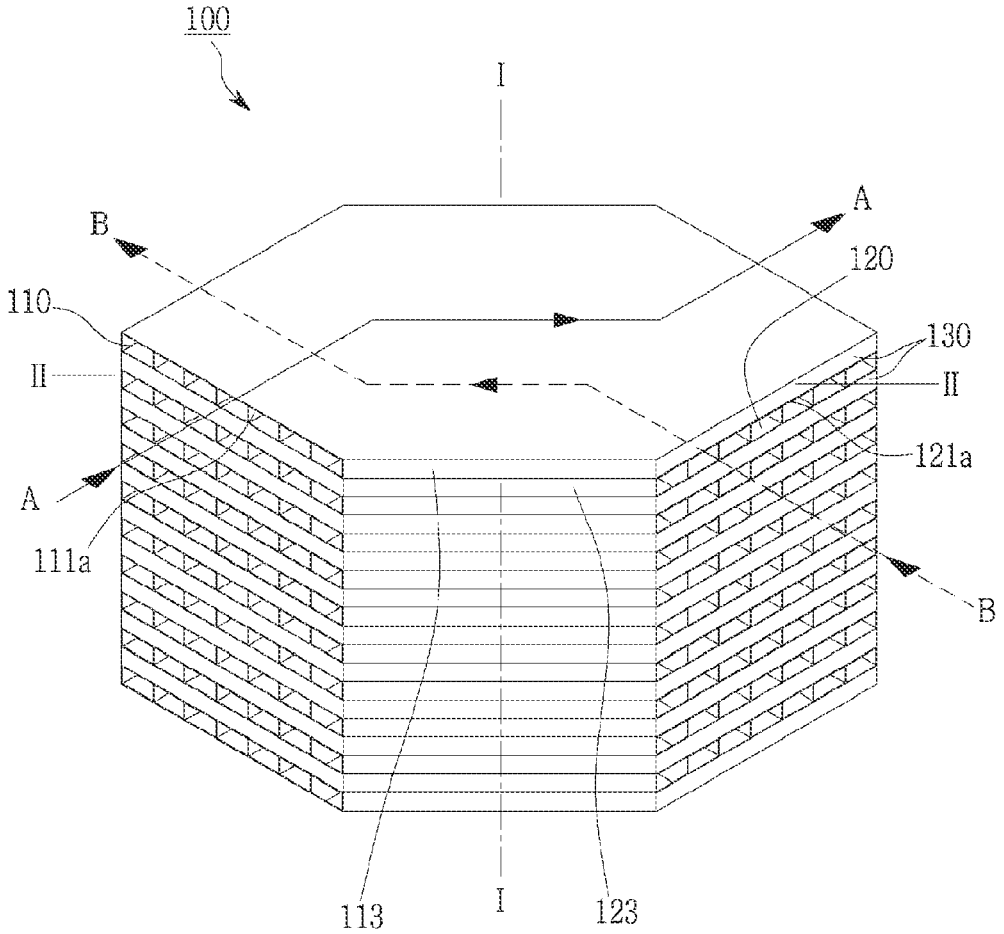
FIG. 4 is a perspective view illustrating a configuration of a counter flow total heat exchanger according to an embodiment of the present invention.

FIG. 4 is a perspective view illustrating a configuration of a counter flow total heat exchanger 100 according to an embodiment of the present invention. The counter current total heat exchanger 100 manufactured by the method of manufacturing the counter flow total heat exchanger according to the present invention includes a plurality of outdoor air supply units 110 and a plurality of indoor air discharge units 120 alternately disposed in a height direction, and a liner 130 disposed between the outdoor air supply unit 110 and the indoor air discharge unit 120 adjacent to the outdoor air supply unit 110 to transfer heat and moisture.

The counter flow total heat exchanger 100 according to the present invention is generally formed in a hexagonal column shape in cross section. The counter flow total heat exchanger 100 moves indoor air B and outdoor air A in a countercurrent manner and exchanges heat to have a high heat exchange efficiency.

In addition, areas of the outdoor air supply unit 110, the indoor air discharge unit 120 and the liner 130 which come into contact with each other are formed of paper to increase heat exchange and moisture transfer efficiency, and resin pipes made of resin are coupled to both sides thereof so that the counter flow total heat exchanger can be manufactured easily at a low price.

Figure 5:
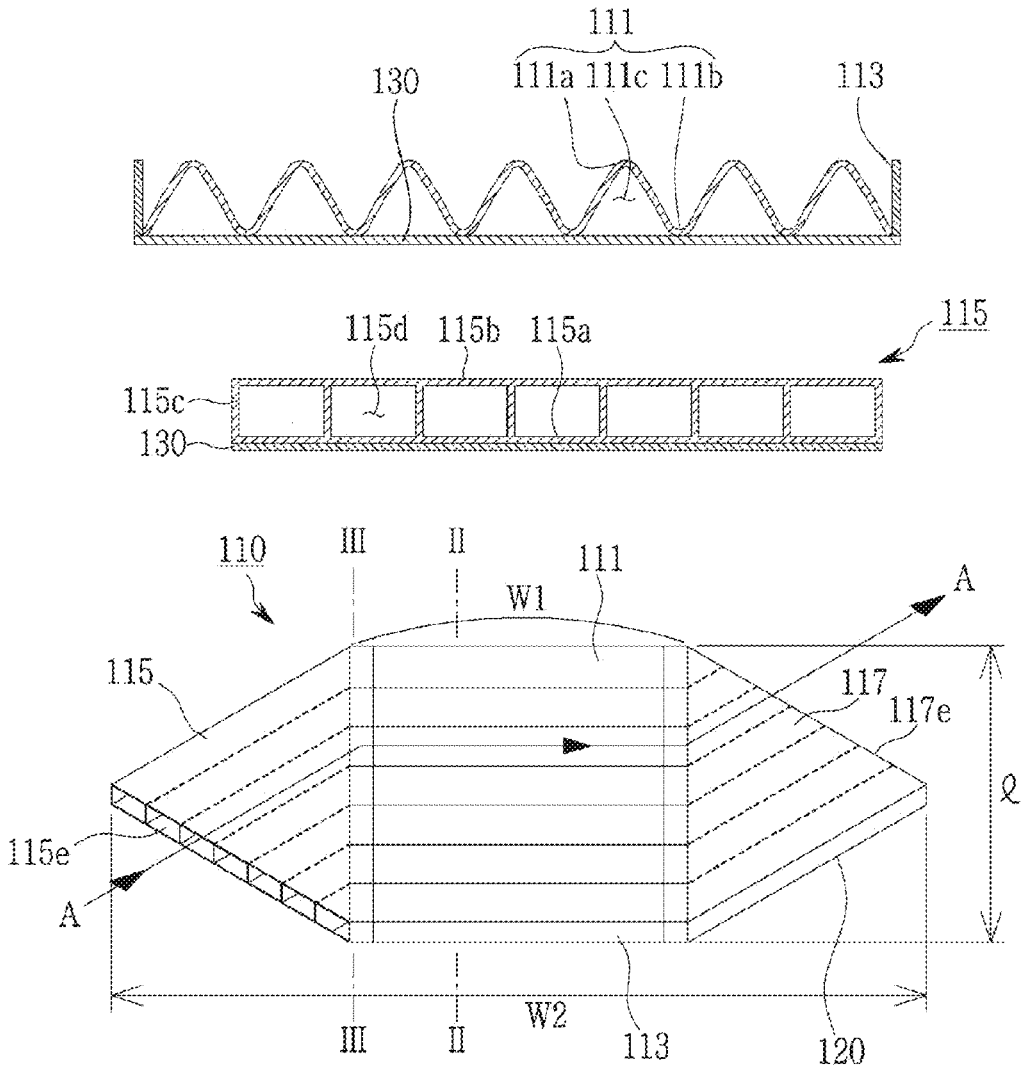
FIG. 5 is a perspective view illustrating a configuration of an outdoor air supply unit of the counter flow total heat exchanger according to an embodiment of the present invention.
Figure 6:
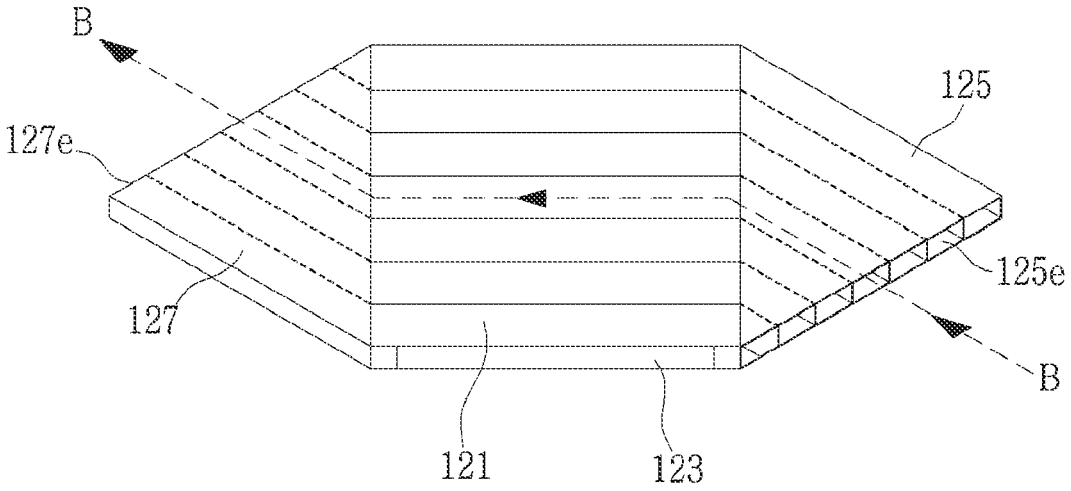
FIG. 6 is a perspective view illustrating a configuration of an indoor air discharge unit of the counter flow total heat exchanger according to an embodiment of the present invention.

FIGS. 5 and 6 are perspective views respectively illustrating the outdoor air supply unit 110 and the indoor air discharge unit 120. As illustrated in FIG. 5, the outdoor air supply unit 110 includes: an outdoor air guide corrugated board 111 made of a paper material to guide the outdoor air A; outdoor air side walls 113 vertically coupled to both sides of the outdoor air guide corrugated board 111 to prevent the outdoor air A from leaking to the outside during movement of the outdoor air A; an outdoor air inflow resin pipe 115 made of a resin material, communicatingly coupled to one side of the outdoor air guide corrugated board 111 to introduce the outdoor air A to the interior; and an outdoor air outflow resin pipe 117 made of a resin material, communicatingly coupled to the other side of the outdoor air guide corrugated board 111 to discharge the outdoor air A to the interior.

As illustrated in the enlarged section view of FIG. 5, the outdoor air guide corrugated board 111 has peaks and valleys formed repeatedly. The outdoor air guide corrugated board 111 has a plurality of outdoor air guide paths 111*c*, which is horizontally formed between the peak 111*a* and the valley 111*b* and through which the outdoor air A moves.

The outdoor air side walls 113 are vertically coupled to both sides of the outdoor air guide corrugated board 111. As illustrated in FIG. 4 and FIG. 7B, in a case in which the plurality of outdoor air supply units 110 and the plurality of indoor air discharge units 120 having hexahedral cross section are stacked on top of one another, the outdoor air side wall 113 is vertically disposed at edges of four sides where an outdoor air inlet 115*e* and an outdoor air outlet 117*e* are not formed, so as to prevent the outdoor air A moving through the outdoor air guide path 111*c* from leaking to the outside.

The outdoor air side wall 113 is vertically attached to the liner 130 outside the outdoor air guide corrugated cardboard 111.

Figure 8:
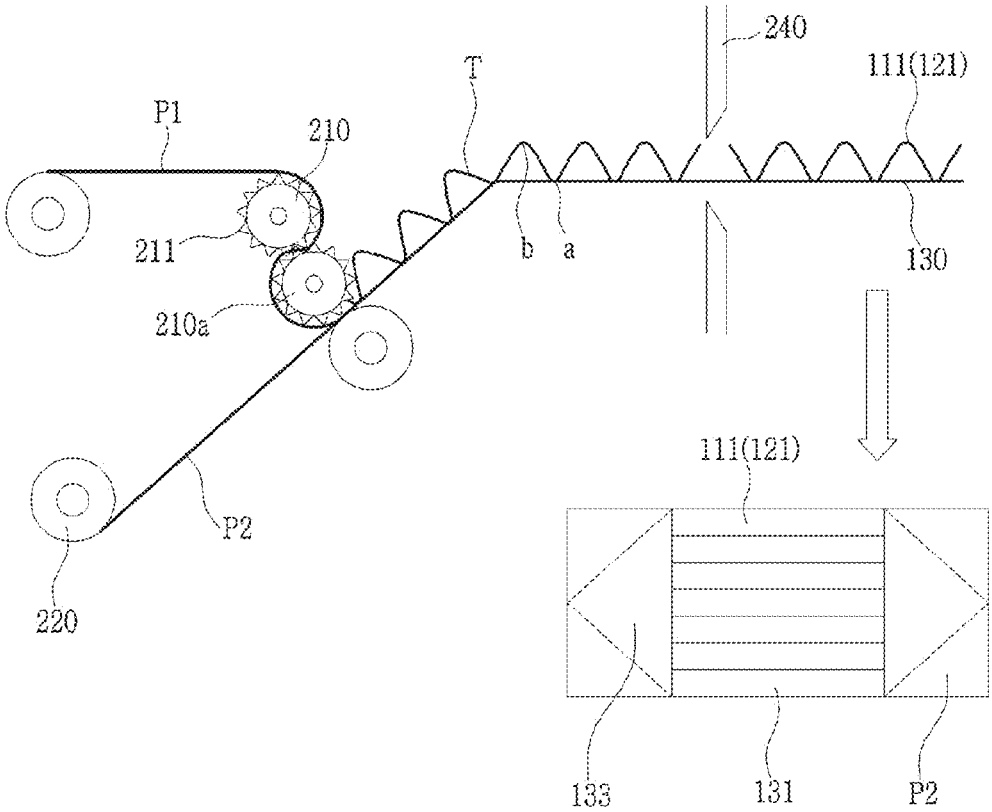
FIG. 8, FIG. 9A, FIG. 9B, FIG. 9C, FIG. 10A, FIG. 10B, FIG. 10C, FIG. 11, FIG. 12 and FIG. 13, are exemplary views illustrating a process of manufacturing a counter flow total heat exchanger according to the present invention.

As illustrated in FIG. 8, the outdoor air guide corrugated cardboard 111 includes a first paper P1 moved between a pair of rollers 210 and 210*a*, and peaks b and valleys a formed on the surface thereof by the roll-to-roll method. Accordingly, it is difficult to integrally mold the outdoor air side walls 113 vertically formed.

Accordingly, the outdoor air side walls 113 are coupled by attaching the paper vertically formed on both sides of the outdoor air guide corrugated cardboard 111. The outdoor air side wall 113 is formed in such a way that paper of the same thickness is adhered on the upper surface of the liner 130 by using an adhesive at a height corresponding to the height of the peaks b and the valleys a.

An outdoor air inflow resin pipe 115 and an outdoor air outflow resin pipe 117 are respectively coupled to both sides of the outdoor air guide corrugated cardboard 111. The outdoor air inflow resin pipe 115 and the outdoor air outflow resin pipe 117 are formed in a right-angled triangle, and one side of each of the outdoor air inflow resin pipe 115 and the outdoor air inflow resin pipe 117 is arranged to be in contact with the outdoor air guide corrugated cardboard 111.

The outdoor air inflow resin pipe 115 is formed of a resin material. The outdoor air inflow resin pipe 115 is formed in such a way that the hollow sheet 300 (see FIG. 11) made of a synthetic resin material is cut so that one side thereof is communicated but the other side is blocked. As illustrated in the enlarged cross-sectional view of FIG. 5, the outdoor air inflow resin pipe 115 includes a bottom plate 115*a* and an upper plate 115*b* formed in parallel and a plurality of partition walls 115*c* vertically formed at regular intervals between the bottom plate 115*a* and the top plate 115*b*.

The outdoor air inflow resin pipe 115 has a plurality of outdoor air inflow paths 115*d* formed between the bottom plate 115*a* and the upper plate 115*b* by the plurality of partition walls 115*c*.

Here, one side of the triangular outdoor air inflow resin pipe 115 is disposed to be in contact with the outdoor air guide corrugated cardboard 111, and an outdoor air inlet 115*e* through which the outdoor air A is introduced to the outdoor air inflow path 115*d* is formed in another side. The other side of the outdoor air inflow resin pipe 115 is blocked by the partition wall 115*c*.

In this instance, the plurality of outdoor air inflow paths 115*d* are formed in one side of the outdoor air guide corrugated cardboard 111 formed horizontally to be bent at a predetermined angle.

The outdoor air outflow resin pipe 117 has the same configuration as the outdoor air inflow resin pipe 115 except for the inclination angle of the outdoor air outflow path. The outdoor air outflow path has an outdoor air outlet 117*e* formed at an end portion thereof.

The outdoor air A is introduced into the outdoor air inlet 115*e* of the outdoor air inflow resin pipe 115, is moved to the outdoor air inflow path 115*d*, and then, is horizontally moved along the outdoor air guide path 111*c* of the outdoor air guide corrugated cardboard 111. Thereafter, the outdoor air A is supplied to the interior through the outdoor air outlet 117*e* of the outdoor air outflow resin pipe 117.

The indoor air discharge units 120 together with the outdoor air supply units 110 are disposed on top of one another by turns to discharge the indoor air B to the outside. The indoor air discharge unit 120 includes an indoor air guide corrugated cardboard 121, indoor air side walls 123 vertically provided at both sides of the indoor air guide corrugated cardboard 121, an indoor air inflow resin pipe 125 for introducing the indoor air B to the indoor air guide corrugated cardboard 121, and an indoor air outflow resin pipe 127 for discharging the indoor air B of the indoor air guide corrugated cardboard 121 to the outside.

The indoor air discharge unit 120 have the same configuration as the outdoor air supply unit 110, but is arranged in such a way that inclination angles of the indoor air inflow resin pipe 125 and the indoor air outflow resin pipe 127 are opposed to those of the outdoor air outflow resin pipe 117 and the outdoor air inflow resin pipe 115 arranged above.

The indoor air B is introduced into the indoor air inlet 125*e* of the indoor air inflow resin pipe 125, is moved along the indoor air guide corrugated cardboard 121, and then is discharged to the indoor air outflow resin pipe 127.

Here, as illustrated in FIG. 4, the indoor air discharge unit 120 and the outdoor air supply unit 110 of the present invention are formed to have a length enough to allow the indoor air B and the outdoor air A to sufficiently come into contact with each other to exchange heat in the indoor air guide corrugated cardboard 121 and the outdoor air guide corrugated cardboard 111.

The liner 130 may be disposed between the plurality of outdoor air supply units 110 and the indoor air discharge units 120 which are alternately arranged in the vertical direction to transfer heat and moisture therebetween. The liner 130 according to the present disclosure is made of paper in the same way as the outdoor air guide corrugated cardboard 111 and the indoor air guide corrugated cardboard 121. Accordingly, the present invention can improve heat transfer efficiency and moisture transfer efficiency.

Figure 7A:
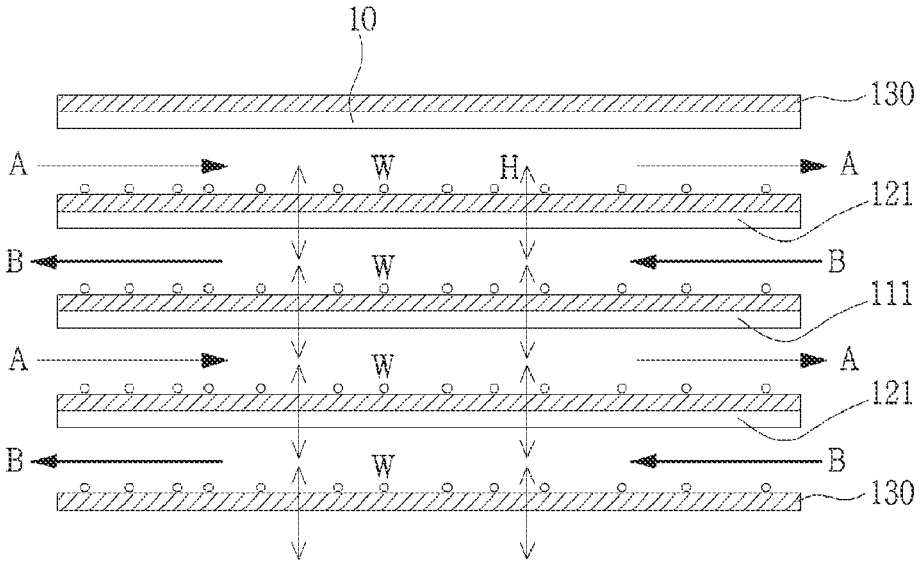
FIGS. 7A and 7B are cross-sectional views illustrating a cross-sectional configuration of the counter flow total heat exchanger according to an embodiment of the present invention.
Figure 7B:
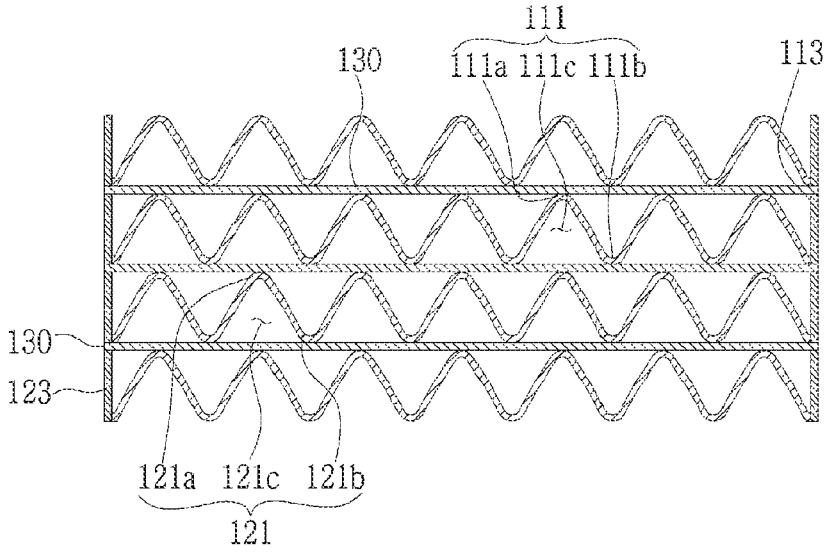

That is, as illustrated in FIG. 7A, the liner 130 is disposed between the outdoor air guide corrugated cardboard 111 and the indoor air guide corrugated cardboard 121 to receive heat from the indoor air guide corrugated cardboard 121 and supply the heat to the outdoor air guide corrugated cardboard 111. In addition, the liner 130 may allow moisture moved along the outdoor air guide corrugated cardboard 111 and the indoor guide corrugated cardboard 121 to be transferred to each other.

Figure 13:
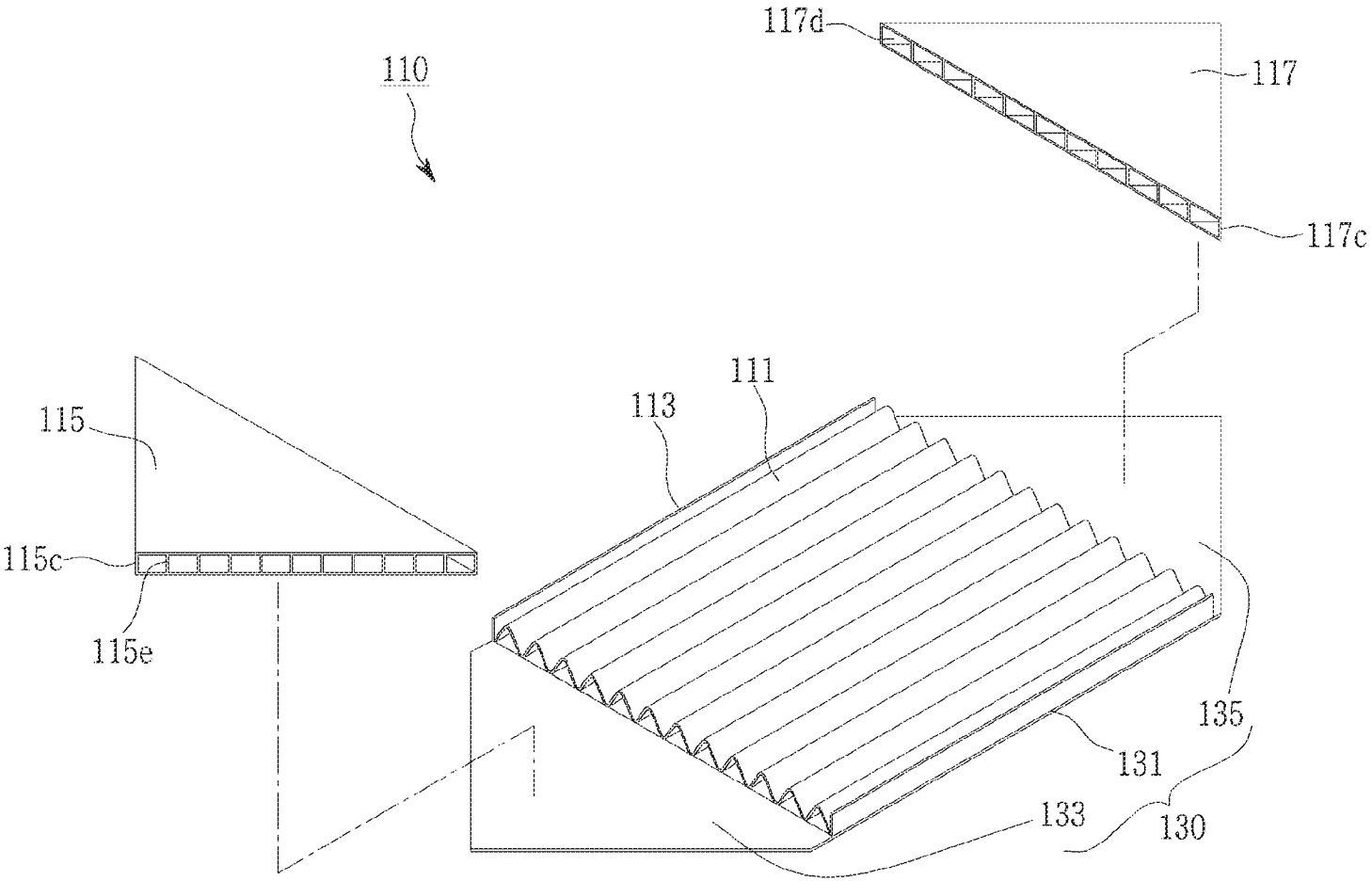

As illustrated in FIG. 13, the liner 130 is cut in a hexagonal shape, and includes: a corrugated cardboard coupling surface 131 in which the outdoor air guide corrugated cardboard 111 or the indoor air guide corrugated cardboard 121 is coupled to a middle portion thereof; and resin pipe coupling surfaces 133 which are formed in a triangular shape at both sides of the corrugated cardboard coupling surface 131 and to which the inflow resin pipes 115 and 125 and the outflow resin pipes 117 and 127 are coupled.

FIGS. 8 to 13 are views schematically illustrating a manufacturing process of the counter flow total heat exchanger 100 according to the present invention.

The counter flow total heat exchanger 100 according to the present invention manufactures the outdoor air guide corrugated cardboard 111, the indoor air guide corrugated cardboard 121, and the liner 130 by using paper, and manufactures the outdoor air inflow resin pipe 115, the outdoor air outflow resin pipe 117, the indoor air inflow resin pipe 125, and the indoor air outflow resin pipe 127 by using the hollow sheet 300. Moreover, when the outdoor air guide corrugated cardboard 111, the outdoor air inflow resin pipe 115, and the outdoor air outflow resin pipe 117 are adhered on the manufactured liner 117, the outdoor air supply unit 110 is manufactured. When the indoor air inflow resin pipe 125 and the indoor air outflow resin pipe 127 are adhered onto the indoor air guide corrugated cardboard 121, the indoor air discharge unit 120 is manufactured.

Then, the manufactured outdoor air supply units 110 and the indoor air discharge units 120 are alternately stacked to complete the counter flow total heat exchanger 100.

FIG. 8 is an exemplary view illustrating a process of manufacturing the outdoor air guide corrugated cardboard 111 and the indoor air guide corrugated cardboard 121 by using paper P1 and P2.

As illustrated, a first paper P1 having a first width W1 is supplied between a pair of rollers 210 and 210*a*. Here, the first width W1 is the width of the outdoor air guide corrugated cardboard 111 as illustrated in FIG. 5. A plurality of protrusions 211 are formed on the surfaces of the pair of rollers 210 and 210*a* along the outer circumferential surface thereof.

The first paper P1 is processed into a corrugated cardboard sheet T on which peaks a and valleys b are formed in the form of a single facer, while passing between the pair of rollers 210 and 210*a*.

The corrugated cardboard sheet T is supplied to the upper portion of the second paper P2. The second paper P2 is formed to have a second width W2 corresponding to the entire width of the liner 130. The second paper P2 is unwound from the second paper supply roller 220 and is supplied to the lower portion of the second roller 210*a*.

Figure 9A:
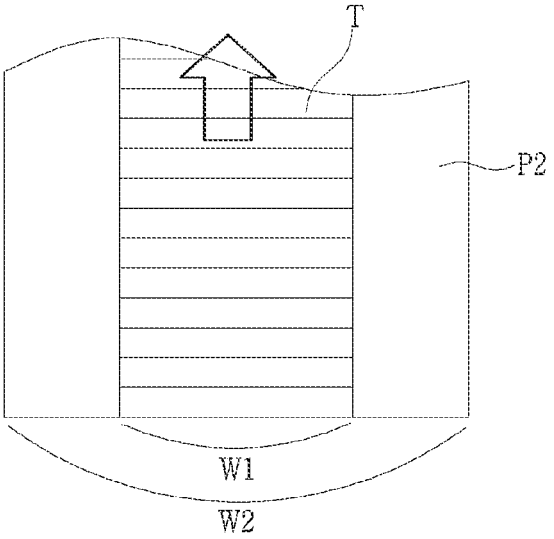

As illustrated in FIG. 9A, the corrugated cardboard sheet T is supplied to the middle region of the second paper P2, and the corrugated cardboard sheet T is adhered to the second paper P2.

Figure 9B:
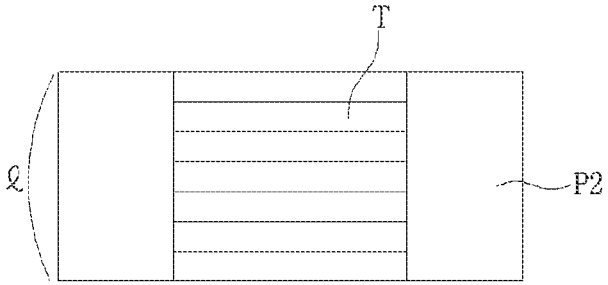

As illustrated in FIGS. 8 and 9B, the second paper P2 to which the corrugated cardboard sheet T is adhered is processed into a shape corresponding to the liner 130 through a first cutting process. The second paper P2 is cut to a length l of the liner 130. Thereby, the corrugated cardboard sheet T is also cut to have the size corresponding to the outdoor air guide corrugated cardboard 111 and the indoor air guide corrugated cardboard 121.

Figure 9C:
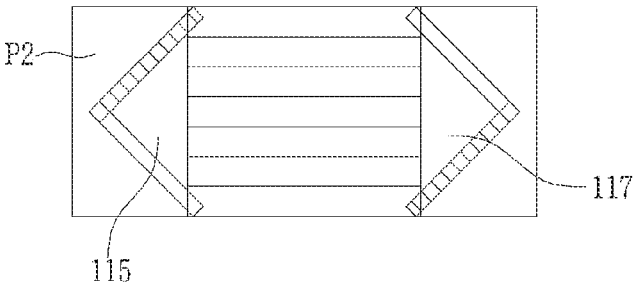

In addition, as illustrated in FIG. 9C, resin pipes 115, 117, 125, and 127 are attached to the upper surface of the second paper P2.

Figure 10A:
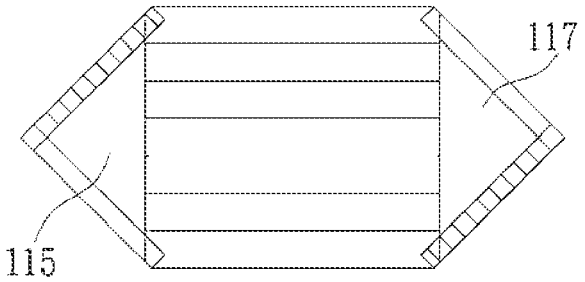

As illustrated in FIG. 10A, the second paper P2 protruding outward from the resin pipes 115, 117, 125, and 127 is cut and is processed to correspond to the resin pipe coupling surface 133. Accordingly, the processing of the liner 130 having the upper surface which the outdoor air guide corrugated cardboard 111 or the indoor air guide corrugated cardboard 121 is coupled is completed.

Figure 11:
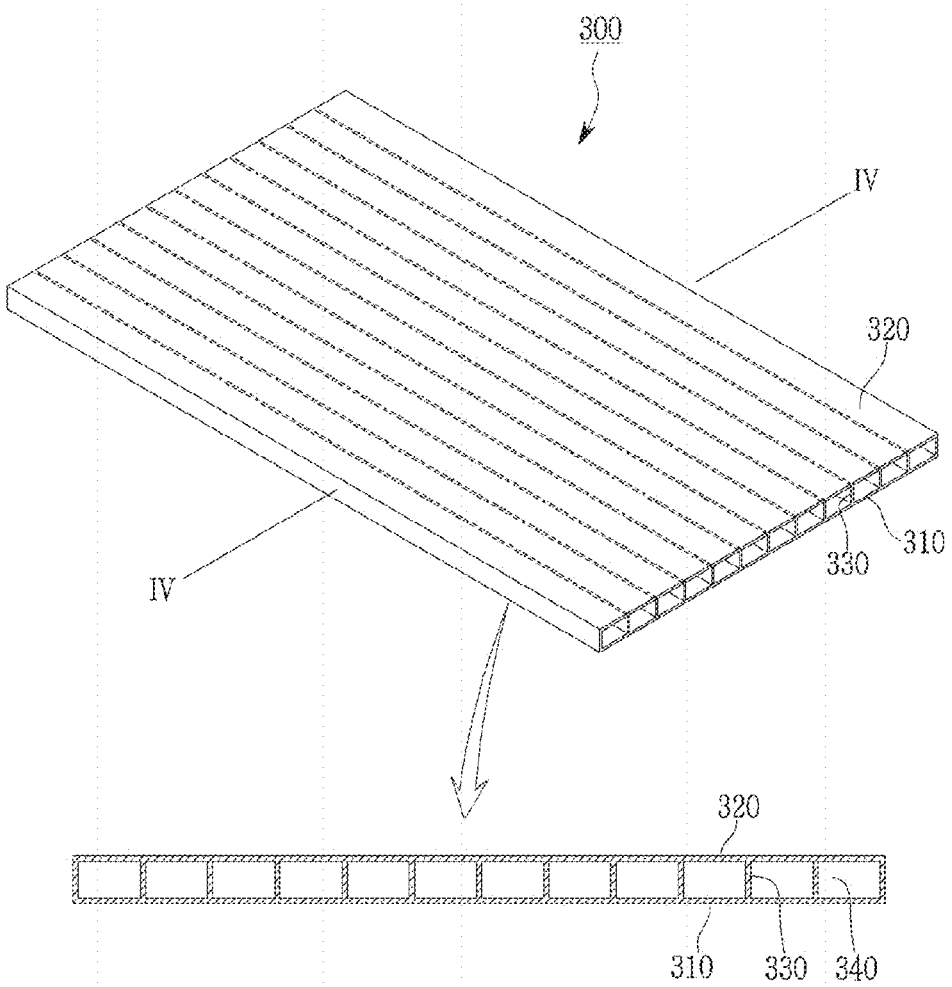

Meanwhile, FIG. 11 is a perspective view illustrating a configuration of the hollow sheet 300. The hollow sheet 300 is a plate-shaped sheet made of a synthetic resin material. The hollow sheet 300 is preferably made of polypropylene, and includes a vertical wall 330 formed between the upper surface 310 and the lower surface 320, and an air movement path 340 linearly formed inside the hollow sheet 300 in a longitudinal direction. The hollow sheet 300 is waterproof, has strong durability and impact resistance, and is widely used in various fields.

Figure 12:
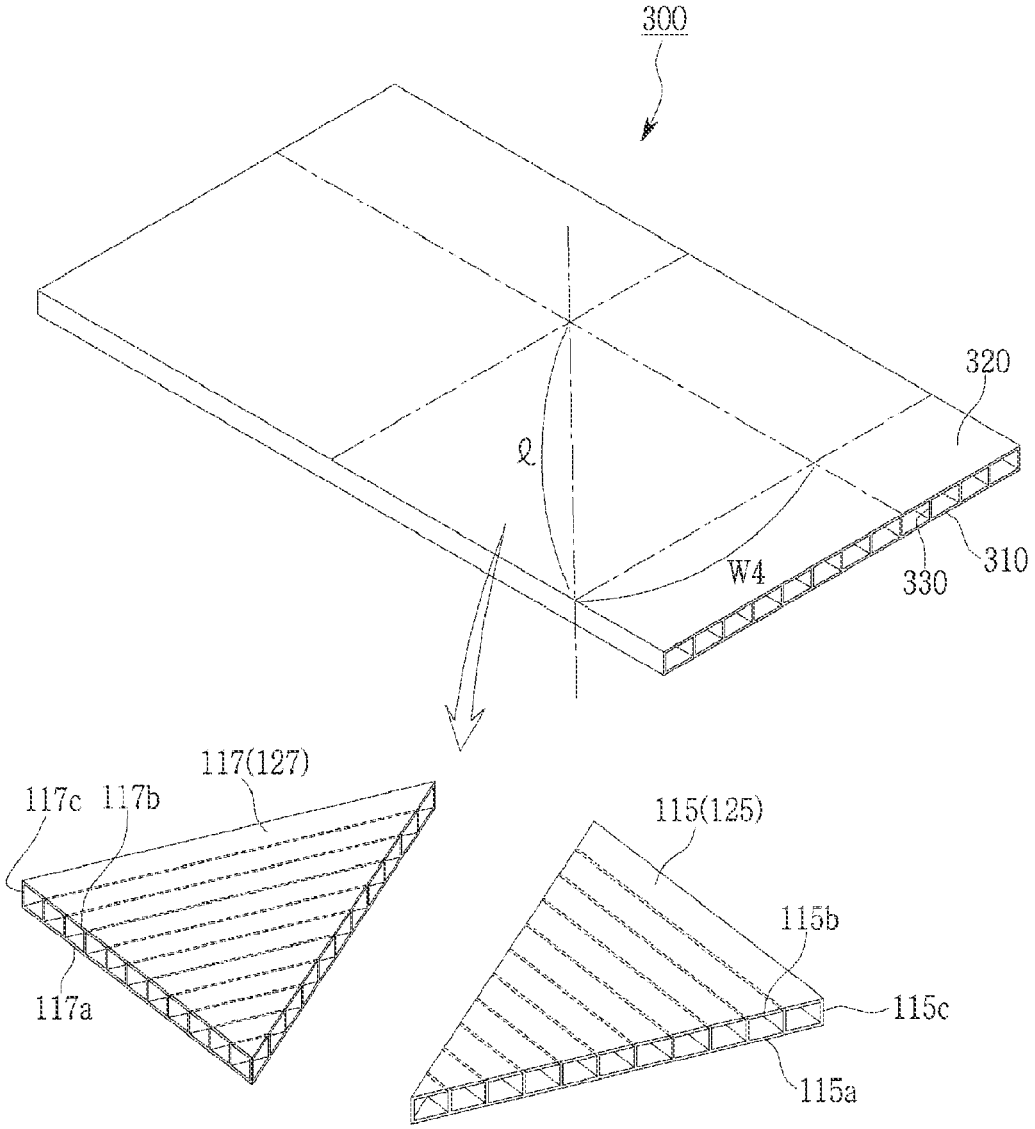

In the present invention, the known hollow sheet 300 is cut as illustrated in FIG. 12 to be processed into the outdoor air inflow resin pipe 115, the outdoor air outflow resin pipe 117, or the indoor air inflow resin pipe 125 and the indoor air outflow resin pipe 127.

The resin pipes 115, 117, 125, and 127 may be cut to have a shape corresponding to the resin pipe coupling surface 133 of the liner 130, or may be cut to have a shape of '<' as illustrated in FIGS. 9 and 10.

In this instance, the resin pipe 115, 117, 125, or 127 is formed in such a way that the hollow sheet 300 is cut perpendicularly so that one side is communicated but the other side is blocked. When the resin pipe is cut as described above, an air flow path is formed, and a resin pipe of a right-angled triangle shape of which one side is blocked can be processed conveniently.

As illustrated in FIG. 13, the processed resin pipes 115, 117, 125 and 127 are attached to the liner 130. The resin pipes 115, 117, 125 and 127 are adhered to the resin pipe coupling surfaces 133 of both sides of the liner 130 having the upper surface to which the outdoor air guide corrugated cardboard 111 or the indoor air guide corrugated cardboard 121 is coupled by an adhesive.

In this instance, according to directions of the resin pipes 115, 117, 125 and 127 adhered to the resin pipe coupling surfaces 133 of the liner 130, the resin pipes are divided into the outdoor air supply unit 110 and the indoor air discharge unit 120. In a case in which the resin pipes 115, 117, 125 and 127 are cut to have a shape of '<', the resin pipes 115, 117, 125 and 127 are spaced apart from the resin pipe coupling surfaces 133, but may be divided into the outdoor air supply unit 110 and the indoor air discharge unit 120 according to directions of the resin pipes 115, 117, 125 and 127.

Figure 10B:
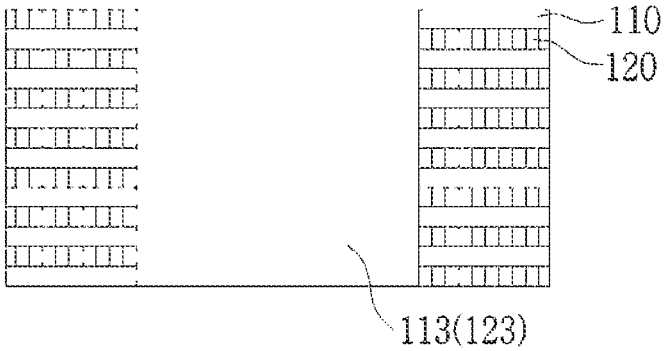

When the plurality outdoor air supply units 110 and the plurality of indoor air discharge units 120 are adhered on the liner 130 and prepared, as illustrated in FIG. 10B, they are alternatively adhered on the liner 130 in the height direction.

Figure 10C:
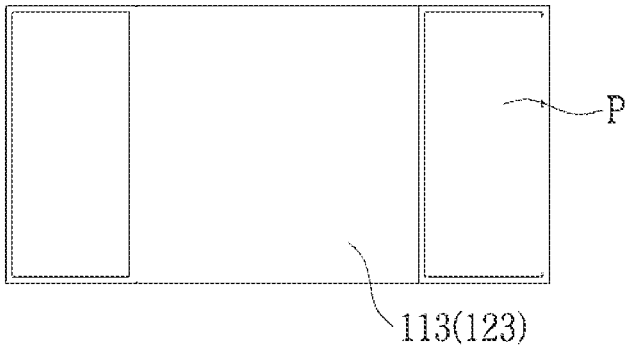

In addition, as illustrated in FIG. 10C, when the surface of the outdoor air supply units 110 and the indoor air discharge units 120, which are alternately stacked, is covered with a frame P, the manufacture of the counter flow total heat exchanger 100 is completed.

As described above, the method for manufacturing the counter flow heat exchanger according to the present invention can manufacture an outdoor air guide corrugated cardboard, an indoor air guide corrugated cardboard, and a liner with general paper by using conventional roll-to-roll equipment.

In addition, the method according to the present invention can simply manufacture the outdoor air supply unit and the indoor air discharge unit by cutting a hollow sheet sold in the market, processing a resin pipe, and adhering the resin pipe to a liner. Additionally, the outdoor air supply unit and the indoor air discharge unit are stacked on top of one another by turns.

Therefore, the method according to the present invention can reduce manufacturing costs since the counter flow heat exchanger is completely manufactured just by the existing roll-to-roll equipment, cutting device, and adhering device without any special equipment.

In addition, since the counter flow total heat exchanger manufactured as described above has the liner, the outdoor air guide corrugated cardboard, and the indoor air guide corrugated cardboard which are made of the same material, thereby enhancing heat transfer efficiency and moisture transfer efficiency.

The technical thoughts of the present invention have been described hereinafter.

It is to be appreciated that those skilled in the art can change or modify the embodiments from the above description in various ways. Although it is not clearly illustrated or described herein, it is to be appreciated that those skilled in the art can change or modify the embodiments from the above description in various ways without departing from the scope and spirit of the present invention and such changes and modifications belong to the scope of the present invention. While the present invention has been described with reference to the particular illustrative embodiments, it is not to be restricted by the embodiments but only by the appended claims.

What is claimed is:

1. A method for manufacturing a counter flow total heat exchanger comprising the steps of:

inserting a first paper having a first width between a pair of rollers (210, 210*a*) having protrusions formed on the surfaces thereof to a single facer corrugated cardboard sheet (T) having flow paths (111*c*, 121*c*);

adhering the corrugated cardboard sheet (T) to a middle region of a second paper having a second width that is wider than the first width, cutting the second paper, to which the corrugated cardboard sheet (T) is adhered, to a length equal to the length of guide corrugated cardboards (111, 121);

cutting the second paper to form a liner (130) having triangular resin tube coupling surfaces (133) formed on both sides, wherein the liner (130) has dimensions corresponding to the cut guide corrugated cardboards (111, 121);

cutting a hollow sheet (300) in which a plurality of air movement paths are formed side by side into resin pipes (115, 117, 125, 127) corresponding to the shape of the resin pipe coupling surfaces (133);

adhering a pair of the cut resin pipes (115, 117, 125, 127) to the resin pipe coupling surfaces (133) of both sides of the liner (130) in such a way that the air movement paths (340) communicate with the flow paths (111*c*, 121*c*); and adhering the guide corrugated cardboards (111, 121) and the plurality of liners (130) to which the resin pipes (115, 117, 125, 127) are coupled to an upper surface in a height direction, wherein:

the guide corrugated cardboards (111, 121) and the liner (130), which are formed in regions where primary heat exchange occurs, are made of a same paper material to improve heat and moisture transfer efficiency:

the corrugated sheet (T) formed during the corrugation process includes flow paths with alternating peaks (111*a*) and valleys (111*b*);

air side walls (113, 123) are vertically attached to both ends of the guide corrugated cardboards (111, 121), wherein the air side walls (113, 123) are configured to prevent external air leakage;

the air side walls (113, 123) are made of the same paper material as the guide corrugated cardboards (111, 121) and are vertically attached to both ends of the guide corrugated cardboards (111, 121) at a height corresponding to the peaks (111*a*) and valleys (111*b*) of the corrugated sheet (T):

the air side walls (113, 123) are attached to an upper surface of the liners (130) and have the same thickness as the corrugated sheet (T);

regions other than the primary heat exchange regions are formed using resin pipes (115, 117, 125, 127) made of a resin material;

the resin pipes (115, 117, 125, 127) are formed by cutting a resin sheet (300) into triangular shapes, and hypotenuse lengths of triangular resin pipes corresponds to the length of the guide corrugated cardboards (111, 121);

the resin sheet (300) comprises a plurality of vertical walls (330) disposed side by side between a horizontally formed upper surface (310) and a lower surface (320) forming multiple air movement paths (340); and the liners (130) comprise resin tube coupling surfaces (133) formed as extensions of the paper material, the resin tube coupling surfaces (133) are configured to engage with the resin pipes (115, 117, 125, 127) to ensure airtightness and facilitate coupling, wherein each of vertical walls (330) within each resin pipe (115, 117, 125, 127) corresponds to each of the peaks (111*a*) and valleys (111*b*) of the guide corrugated cardboard (111, 121).

2. The method according to claim 1, wherein:

the resin pipes (115, 117, 125, 127) are formed to correspond to the resin pipe coupling surfaces (133); and any one of two sides except one side getting in contact with the guide corrugated cardboard (111, 121), among three sides of the resin pipes (115, 117, 125, 127) is cut to be blocked by the vertical walls (330).

3. The method according to claim 2, wherein the resin pipes (115, 117, 125, 127) are coupled to be inclined at a predetermined angle with respect to the flow paths (111*c*, 121*c*) of the guide corrugated cardboards (111, 121) and to communicate with an air inflow path ; and wherein the resin pipes (115, 117, 125, 127) vertically stacked are arranged such that coupling angles to be coupled with the guide corrugated cardboards (111, 121) are opposed to each other.

* * * * *